US009042587B2

(12) United States Patent
Yang

(10) Patent No.: US 9,042,587 B2
(45) Date of Patent: May 26, 2015

(54) HEADPHONE

(71) Applicant: Bill Yang, Taipei (TW)

(72) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 0 days.

(21) Appl. No.: 13/972,919

(22) Filed: Aug. 22, 2013

(65) Prior Publication Data

US 2014/0301590 A1 Oct. 9, 2014

(30) Foreign Application Priority Data

Apr. 3, 2013 (TW) ..... 102112175 A

(51) Int. Cl.
*H04R 25/00* (2006.01)
*H04R 1/10* (2006.01)

(52) U.S. Cl.
CPC ..... *H04R 1/1066* (2013.01)

(58) Field of Classification Search
CPC .... H04R 1/10; H04R 2205/022; H04R 1/105; H04R 5/0335; H04R 2210/10
USPC ..... 381/370–371, 374, 376–379, 381, 383
See application file for complete search history.

(56) References Cited

U.S. PATENT DOCUMENTS

| | | | | |
|---|---|---|---|---|
| 2,862,071 | A * | 11/1958 | Bonnaffous | 381/378 |
| 3,456,563 | A | 7/1969 | Roesner et al. | |
| 4,499,593 | A * | 2/1985 | Antle | 381/378 |
| 4,776,044 | A * | 10/1988 | Makins | 381/376 |
| 6,888,950 | B2 * | 5/2005 | Siskin et al. | 381/378 |
| 8,094,858 | B2 * | 1/2012 | Thiel et al. | 381/378 |
| 8,213,667 | B2 | 7/2012 | Nelson et al. | |
| 8,488,814 | B2 * | 7/2013 | Robuchon et al. | 381/378 |
| 2011/0235819 | A1 | 9/2011 | Alden | |

FOREIGN PATENT DOCUMENTS

| | | |
|---|---|---|
| JP | U58147385 | 10/1983 |
| JP | U58155188 | 10/1983 |
| JP | U60167493 | 11/1985 |
| JP | 2005269075 | 9/2005 |
| JP | 2007158924 | 6/2007 |
| JP | U3165555 | 1/2011 |
| JP | 2012105118 | 5/2012 |
| TW | 503911 | 9/2002 |

OTHER PUBLICATIONS

"Office Action of Japan Counterpart Application", issued on Jul. 29, 2014, p. 1-p. 3, in which the listed references were cited.

"Office Action of Taiwan Counterpart Application", issued on Dec. 1, 2014, p. 1-p. 4, in which the listed references were cited.

* cited by examiner

*Primary Examiner* — Suhan Ni
(74) *Attorney, Agent, or Firm* — Jianq Chyun IP Office

(57) ABSTRACT

A headphone including two earphone cups, a main strap and a decorating strap is provided. Two ends of the main strap are connected to the earphone cups. Two ends of the decorating strap are detachably connected to the earphone cups or the main strap and rotatable corresponding to the earphone cups or the main strap.

2 Claims, 4 Drawing Sheets

HEADPHONE

CROSS-REFERENCE TO RELATED APPLICATION

This application claims the priority benefit of Taiwan application serial no. 102112175, filed on Apr. 3, 2013. The entirety of the above-mentioned patent application is hereby incorporated by reference herein and made a part of this specification.

FIELD OF THE INVENTION

The present invention relates to an earphone, specifically to a headphone.

DESCRIPTION OF RELATED ART

With the rapid progress in science and technology, all electronic products have been developed towards light, handy and miniaturized designs. For the sake of conveniently listening to sound information provided by electronic products without disturbing other people around, people may use miniaturized electronic products, an earphone has become a necessary accessory to the electronic product. Moreover, the earphone also provides a listener better audio transmission so that the listener can clearly hear and understand content of the audio information. In contrast to unclear audio transmission through the air, especially when the listener is moving, for example like doing exercises, driving, intensely moving around or being in a noisy environment, the audio transmission of the earphone still would not be affected.

Among various types of earphones, headphones can provide a comfortable wearing feeling and excellent sound quality, and thus become a users' favorite earphone type. FIG. 1 is a schematic view of a conventional headphone. Referring to FIG. 1, a headphone 10 including two earphone cups 12 and a strap 14 is provided in US Patent Publication No. 2011/0235819. Each of the two ends of the strap 14 has a hooking clamp 14A. By using the hooking clamps 14A, the two ends of the strap 14 can detachably hook the two earphone cups 12. Therefore, the user can change the strap 14 according to different preferences and requirements. However, once the strap 14 is lost when it is detached and replaced by the user, the earphone cups 12 cannot be fixedly worn by the user at the ears, and it may cause inconvenience to the user during using.

SUMMARY OF THE INVENTION

The present invention provides a headphone.

The headphone of the present invention includes two earphone cups, a main strap and a decorating strap. The two ends of the main strap are connected to the two earphone cups. The two ends of the decorating strap are rotatable corresponding to the two earphone cups or the main strap and detachably connected to the two earphone cups or the main strap.

According to an exemplary embodiment of the present invention, a logo is drawn on the decorating strap.

According to an exemplary embodiment of the present invention, each of the earphone cups or each of the two ends of the main strap has a shaft, and the two ends of the decorating strap are pivotally connected to the shafts.

According to an exemplary embodiment of the present invention, each of the shafts has a plurality of recesses, and each of the two ends of the decorating strap has at least one tenon. Each of the at least one tenon is used for buckling to one of the recesses to fix the position of the decorating strap.

In light of the above, the headphone of the present invention has a main strap that can be fixed to a user's head and a decorating strap that is rotatable and detachable, thus the headphone has both applicability and exquisite appearance.

To make the above features and advantages of the present invention more comprehensible, several embodiments accompanied with drawings are described in detail as follows.

DESCRIPTION OF EMBODIMENTS

Figure 1:
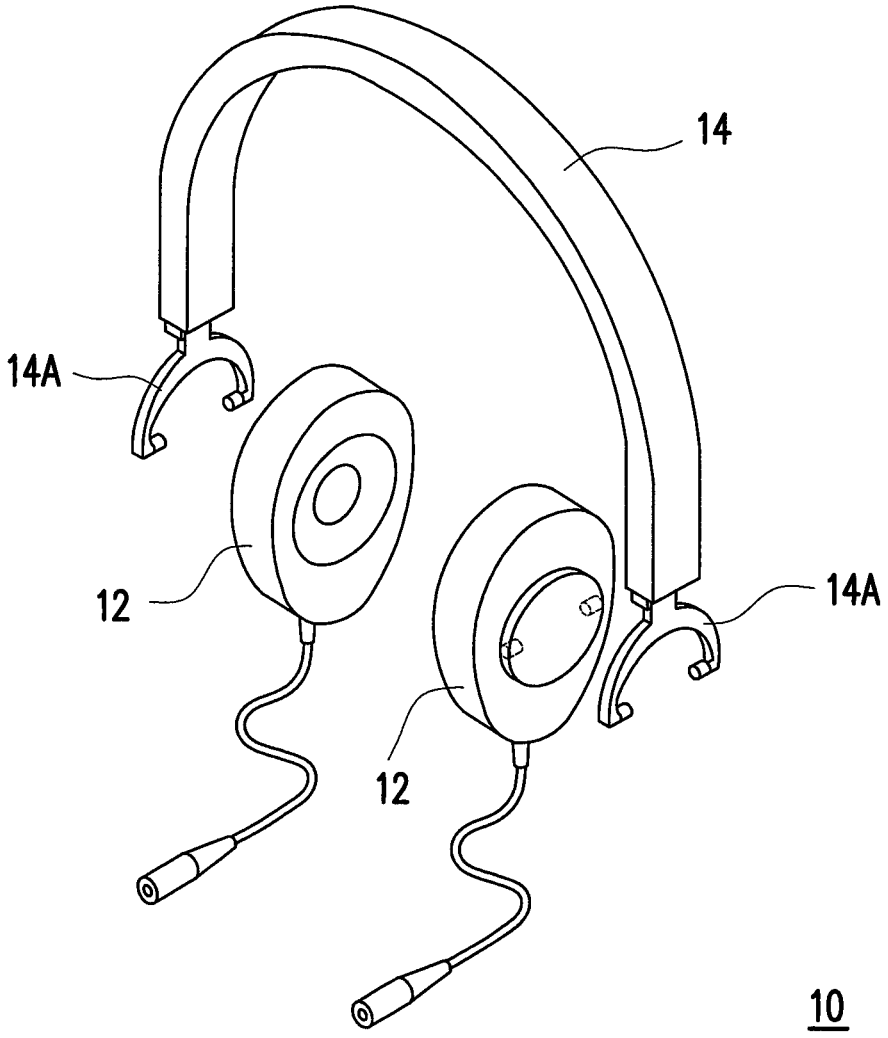
FIG. 1 (RELATED ART)
FIG. 1 is a schematic view of a conventional headphone.
Figure 2:
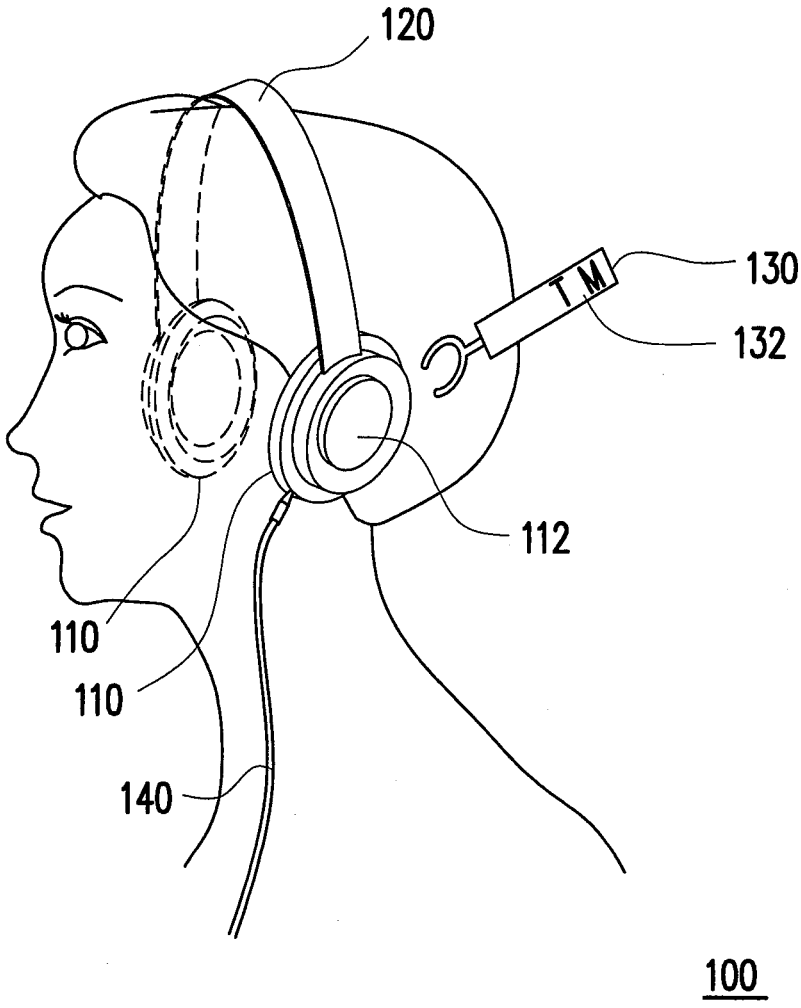
FIG. 2 is a perspective view of a headphone according to an embodiment of the present invention.

FIG. 2 is a perspective view of a headphone according to an embodiment of the present invention. Referring to FIG. 2, the headphone 100 of the present embodiment includes two earphone cups 110, a main strap 120 and a decorating strap 130. The two ends of the main strap 120 are connected to the two earphone cups 110. Specifically, the main strap 120 and the earphone cups 110 are connected in a fixed manner, meaning that losing the main strap 120 after the main strap 120 is detached would no longer happen. Therefore, the main strap 120 provides an appropriate support so that the two earphone cups 110 are attached to the user's ears and provide sound. Certainly, a rotatable or a shiftable design can be employed between the main strap 120 and the decorating strap 110 as required. In addition, the two earphone cups 110 are connected to an audio source device through two audio source wires (not shown). Or, after only one earphone cup 110 is connected to the audio source device through a single audio source wire 140, the audio signal is transmitted to another earphone cup 110 through the main strap 120.

The two ends of the decorating strap 130 are rotatable corresponding to the earphone cups 110 and detachably connected to the earphone cups 110. Therefore, the user can rotate and position the decorating strap 130 as he/she likes, such as back of the head, forehead, or the like. Additionally, the user can change different decorating straps 130 according to occasion or mood, so that the decorating strap 130 can be a part of personal styling, and the commercial value of the headphone 100 of the embodiment is significantly increased. The decorating strap 130 may have a logo 132, or any other letter or picture, drawn thereon. Moreover, the decorating strap 130 may be fabricated by a material having better elasticity. Accordingly, when the decorating strap 130 and the two earphone cups 110 are connected, the decorating strap 130 provides strength such that the earphone cups 110 tightly press the user's ears for providing a better sound quality.

Figure 3:
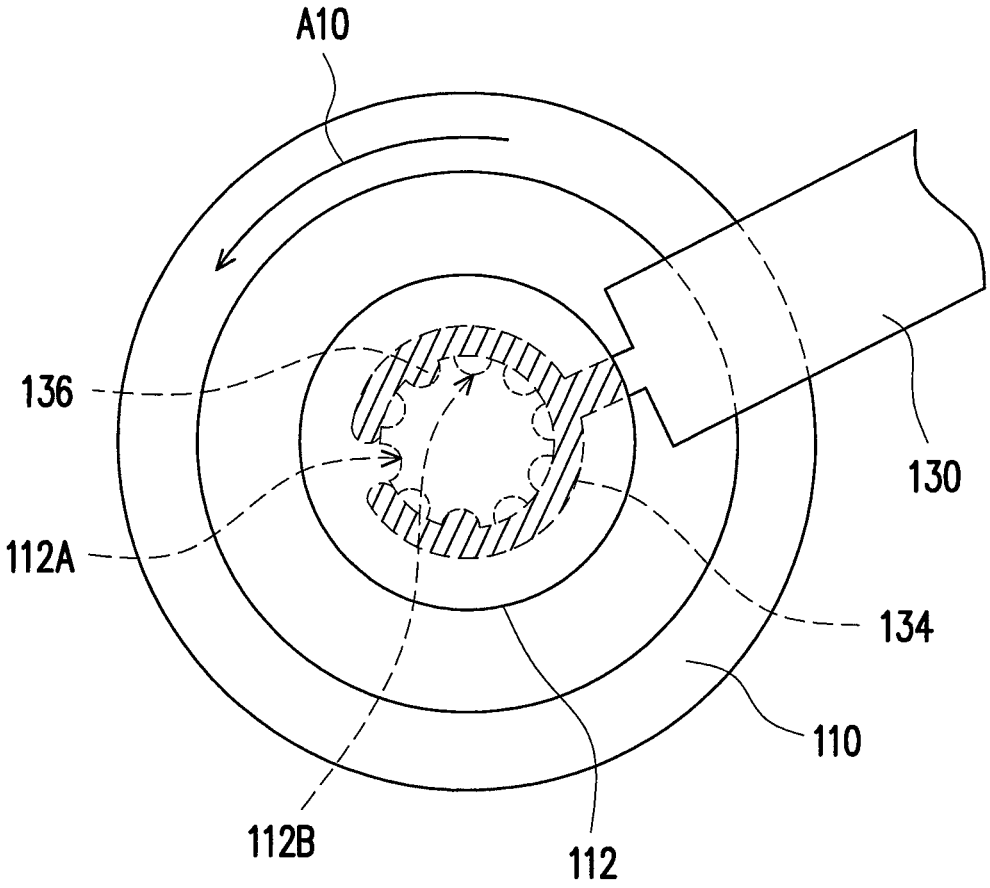
FIG. 3 is a schematic partially enlarged view illustrating the headphone depicted in FIG. 2 from another view angle.

FIG. 3 is a schematic partially enlarged view illustrating the headphone depicted in FIG. 2 from another view angle. The earphone cup 110 of the embodiment is shaped as a round disk, and the decorating strap 130 rotates along the peripheral direction A10 of the earphone cup 110. For example, the earphone cup 110 has a shaft 112, and the two ends of the decorating strap 130 are pivotally connected to the shafts 112 of the two earphone cups 110. In other words, the two ends of the decorating strap 130 are rotatably connected to the two shafts 112. Specifically, the shaft 112 is provided with an annular groove 112A in the present embodiment. Each of the two ends of the decorating strap 130 has a C-shaped lock portion 134. The lock portion 134 is made of an elastic material and deformable to be locked in the annular groove 112A of the shaft 112. In addition, the lock portion 134 still can rotate along the peripheral direction A10 of the earphone cup 110 with respect to the earphone cup 110 after it is locked in the annular groove 112A, and a certain amount of force is needed for the lock portion 134 to be separated from the earphone cup 110. Moreover, the annular groove 112A of each of the shafts 112 can be designed as having a plurality of recesses 112B, and the lock portion 134 of the two ends of the decorating strap 130 has at least one tenon 136. Each of the tenons 136 is used for buckling to one of the recesses 112B, wherein the buckling force between the tenon 136 and the recess 112B can properly fix the position of the decorating strap 130 with respect to the earphone cup 110, so as to prevent the arbitrary rotating of the decorating strap 130 which causes inconvenience for the user. In addition, the user can selectively let the tenon 136 buckled in any of the recesses 112B, so as to fix the decorating strap 130 in any position. Through the design, the two ends of the decorating strap 130 are rotatable corresponding to the earphone cups 110 and detachably connected to the earphone cups 110.

The abovementioned incorporating of the lock portion 134 and the annular groove 112A of the shaft 112 is just illustrated as an example. Any other design as long as the decorating strap 130 can be rotatably and detachably connected to the earphone cup 110 can be applied to the headphone of the present invention.

Another embodiment is given for illustration below. It has to be mentioned that reference numerals the same as that of the above embodiment are used in this embodiment to indicate similar components, and other features of the relevant technology will not be repeated herein any more, which can be obtained with reference to the content of the above embodiments. For a detailed description of this section, reference can be found in the abovementioned embodiment of the invention, therefore no further description is contained herein.

Figure 4:
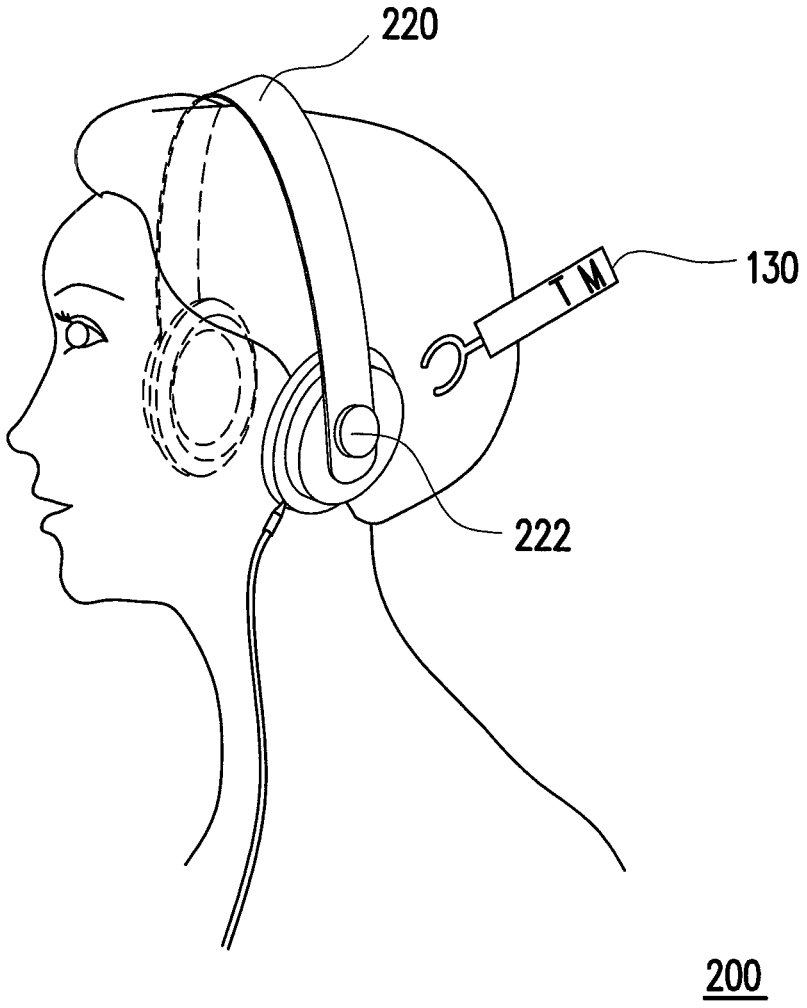
FIG. 4 is a schematic view of a headphone according to another embodiment of the present invention.

FIG. 4 is a schematic view of a headphone according to another embodiment of the present invention. Referring to FIG. 4, the headphone 200 is similar to the headphone 100 of FIG. 2, and the difference is: in the present embodiment, the two ends of the decorating strap 130 are rotatable corresponding to the main strap 220 and detachably connected to the main strap 220, for example, are pivotally connected to the two shafts 222 of the two ends of the main strap 220. Similar to the headphone 100 of FIG. 2, the decorating strap 130 of the headphone 200 of the embodiment can be rotated to be in any position, and the user can change different decorating strap 130 according to occasion or mood, so that the decorating strap 130 can be a part of personal styling.

In light of the foregoing, the decorating strap of the headphone of the present invention can be rotatable corresponding to the earphone cups and detachably connected to the earphone cups, and thus can be replaced and rotated to a position that the user feels comfortable. Furthermore, the headphone of the present invention retains the undetachable main strap which can be used for fixing the whole headphone to the user's head and has both applicability and exquisite appearance.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. A headphone, comprising:

two earphone cups;

a main strap, wherein two ends of the main strap are connected to the earphone cups; and a decorating strap, wherein two ends of the decorating strap are rotatable corresponding to the earphone cups or the main strap, and detachably connected to the earphone cups or the main strap, wherein each of the earphone cups or each of the two ends of the main strap has a shaft, and the two ends of the decorating strap are pivotally connected to the shafts, and wherein each of the shafts has a plurality of recesses, each of the two ends of the decorating strap has at least one tenon, and each of the at least one tenon is used for buckling to one of the recesses to fix the position of the decorating strap.

2. The headphone as claimed in claim 1, wherein a logo is drawn on the decorating strap.

* * * * *